United States Patent [19]

Yannotti et al.

[11] Patent Number: 4,908,607

[45] Date of Patent: Mar. 13, 1990

[54] ANTI-PICKPOCKET ALARM

[76] Inventors: Julian J. Yannotti, 8-18 College Point Blvd., Queens, N.Y. 11356; Thomas Johnson, 18 Kensington Pl., East Orange, Nev. 02017

[21] Appl. No.: 313,886

[22] Filed: Feb. 23, 1989

[51] Int. Cl.[4] ..... G08B 13/14

[52] U.S. Cl. ..... 340/571; 340/687

[58] Field of Search ..... 340/571, 568, 652, 687, 340/825.72, 825.49, 539; 150/102, 134; 116/84

[56] References Cited

U.S. PATENT DOCUMENTS

| | | | |
|---|---|---|---|
| 2,927,311 | 3/1960 | Donaldson | 340/571 |
| 3,815,118 | 6/1974 | McDonald | 340/571 |
| 3,851,326 | 11/1974 | Costa | 340/571 |
| 3,938,126 | 2/1976 | Ransom | 340/571 |
| 4,080,595 | 3/1978 | Rosen | 340/568 |
| 4,394,644 | 7/1983 | DiLeo et al. | 340/571 |
| 4,598,272 | 7/1986 | Cox | 340/539 |
| 4,633,232 | 12/1986 | Nelson et al. | 340/571 X |

FOREIGN PATENT DOCUMENTS

| | | | |
|---|---|---|---|
| 3008846 | 10/1981 | Fed. Rep. of Germany | 340/571 |
| 2519787 | 7/1983 | France | 340/571 |
| 0038900 | 3/1977 | Japan | 340/571 |
| 2101783 | 1/1983 | United Kingdom | 340/571 |

*Primary Examiner*—Glen R. Swann, III
*Assistant Examiner*—Thomas J. Mullen, Jr.
*Attorney, Agent, or Firm*—Richard C. Litman

[57] ABSTRACT

A security apparatus for alerting an individual that their wallet or the like device has been stolen from their person includes a housing containing an alarm concealed within the wallet and tethered to the individual or another article being carried. The wallet alarm sounds when the wallet is removed far enough to tighten and disconnect the tether from the wallet. This action activates the alarm. In another embodiment, a second alarm concealed on the person or in a handbag is also activated simultaneously when the tether is pulled, alerting the wearer as well as the distant thief.

8 Claims, 1 Drawing Sheet

ANTI-PICKPOCKET ALARM

FIELD OF THE INVENTION

The present invention relates to security devices which are worn within personal articles on or near a person to alert the wearer of the theft of the articles from his person.

BACKGROUND OF THE INVENTION

The increasing use of credit cards has instilled new vigor into the ancient craft of pickpocketing, as the theft of one's purse or wallet, with its typical assortment of such cards can produce hundreds and even thousands of dollars in ill-gotten gains. This is particularly true if the loss of one's wallet is not detected immediately, giving the thief/thieves time to run up expensive charges before the cards can be invalidated by their owner.

Any successful theft deterrent device to be worn on a person's body or carried in a purse must operate under guidelines which anticipate a pickpocket's methods and his behavior if caught in the act or apprehended.

Pickpockets frequently work in teams of two or more individuals. The least complex, a two-man team, consists of a "stall" who intentionally attracts a would-be victim's attention while a second individual, a "pick", actually removes an article from the victim's clothing or purse. Skillfully done, the victim will not notice the theft immediately, giving the thieves an opportunity to disappear. In some cases, teams of three or more cooperate to pass the stolen article from one to another, thus further escaping detection.

Aside from detection, no pickpocket wants a confrontation with a victim. Being caught in the act, in close proximity to his victim, may panic a pickpocket, causing him to react violently in an attempt to escape. This is particularly true of alarms carried by the victim, which go off when a thief is in body contact with his victim.

DESCRIPTION OF THE RELATED ART

Prior art theft prevention devices include such alarms, as well as retainers, to make removal from the victim difficult. The anti-pickpocket warning device of U.S. Pat. No. 4,083,321 to LeBron, et al. is characteristic of both types of device. A wallet is retained in a wearer's pocket by strips of releasable hook-and-loop material. When a thief attempts to remove the wallet, the wearer will feel a tug as the wallet is pulled, thus alerting the wearer. If the wallet is actually removed, the characteristic rippling sound of hook-and-loop material being separated is produced, further alerting the wearer.

The wallet guard of U.S. Pat. No. 4,080,595 to Rosen relates to an alarm which is actuated when a wallet is removed from a person, pulling a chain to which it is attached and releasing the alarm.

Devices of the above type all suffer from a common shortcoming. The wearer of the device is alerted when the thief is close at hand, probably within physical contact range. With the retractable chain type, the wallet is easily removed by cutting the chain, which may not cause the alarm to go off.

SUMMARY OF THE INVENTION

By the present invention an improved portable security device for wearing on one's person is devised, in order to prevent theft of personal articles. Accordingly, one of the objects of the present invention is to provide an improved portable security system to prevent a wallet being stolen from a person's pocket or purse.

It is therefore an object of this invention to provide a pickpocket alarm which operates in such a manner as to anticipate the behavior of a pickpocket so as to most effectively recover the stolen item with minimum danger to the victim, while attracting attention to the thief to aid in his capture.

Another object is to provide a first alarm which is installed in a person's wallet and which is activated when the wallet is removed but at a distance from either the victim's person or his/her purse.

A further object is to provide a second alarm which is worn on the person of an intended victim or in his/her purse, and which is activated when his wallet with a first alarm is removed a distance away from him.

A still further object is to provide a flexible tether between the first and second alarms which is removably connected to the first alarm and fixedly connected to the second alarm.

Another object is to provide means so that removing the tether from the first alarm by pulling on it activates both the first and second alarms.

Yet another object is to provide means so that severing the tether between the first and second alarms causes both alarms to become activated.

Another object is to provide an energy source integral with the second alarm which powers both the first and the second alarms.

A further object is to provide an energy storage means in the first alarm which is replenished by the energy source in the second alarm, and which powers the first alarm when it is disconnected from the second alarm.

Another object is to provide fastening means on both the first and second alarms to engage clothing or other articles to prevent theft.

Another object is to provide testing and arming means on the first and second alarms in order to test each separately or when connected together.

Another object is to provide different tones for the first and the second alarms in order to distinguish them quickly once activated.

With these and other objects in view which will more readily appear as the nature of the invention is better understood, the invention consists in the novel construction, combination and assembly of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
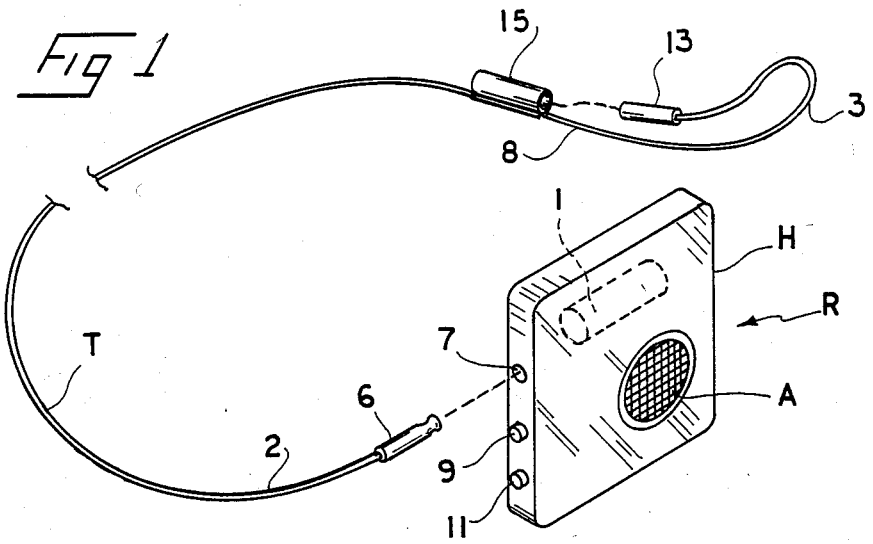
FIG. 1 is a perspective view of one embodiment of the invention showing a first alarm and tether.

In a first embodiment, shown in FIG. 1, a remote alarm R, comprising a relatively flat housing H includes a self-contained power source 1 electrically joined to an alarm device A, preferably of the audible type. The remote alarm R is detachably joined to a thin, flexible, electrically conductive tether T at a first end 2 and which has at its opposite, second end 8, a formable loop 3 for attaching the tether to the clothing of the user of the alarm R. Loop 3 is formed by bending the tether end 8 back on itself and inserting a distal plug 13 thereon into a continuity receptacle or connector 15 attached to the tether, inwardly of its end 8. The tether first end 2 adjacent the alarm R is provided with an end plug 6 which mates within a jack or receptacle 7 in the alarm housing H and which is installed by simply inserting the plug 6 into the receptacle 7.

The alarm R is further provided with a self-test activator 9 and an alarm actuator 11, both of which are concealed, locked or otherwise made difficult to find or operate by anyone but the user, so as to protect against others deactivating the alarm R.

The self-contained power source 1 is envisioned to be replaceable by the user should the need for replenishment be indicated when the alarm R is tested. On the other hand, the power source 1 may comprise a rechargeable device, with the tether T serving as a conduit for the recharging energy. In that regards, the plug 13 mates with a receptacle in a source of energy (not shown) and through which the recharging energy can be transmitted.

The tether T itself is preferably electrically conductive and thus is so constructed as to activate the remote alarm R should it be severed by cutting or pulling, even when the alarm remains attached. This serves as a further safeguard against theft in the event the thief observes the tether before it is stretched tight and disconnects either plug 6 or 13, and he should cut or break it.

In this respect it will be understood that any well known circuitry may be employed to activate the alarm device A. Since the tether T serves as the trip mechanism for the alarm device A it follows that an appropriate circuit will be provided that is normally open when the tether plugs 6 and 13 are seated in their respective receptacles 7 and 15 and the tether body remains intact. In this manner, separation of either plug from its receptacle or severance of the conductors (not shown) in the tether will be understood to close the circuit supplying current from the power source 1 to the alarm device A.

The remote alarm R is, of course, compact and unobtrusive and must necessarily be provided with retaining means to attach it to a wallet W or other object to be protected. Although the power source 1 is preferably a dry cell battery, the energy to power the alarm can be mechanical, electrical, chemical or any other type which can be stored and released when and as needed.

Figure 2:
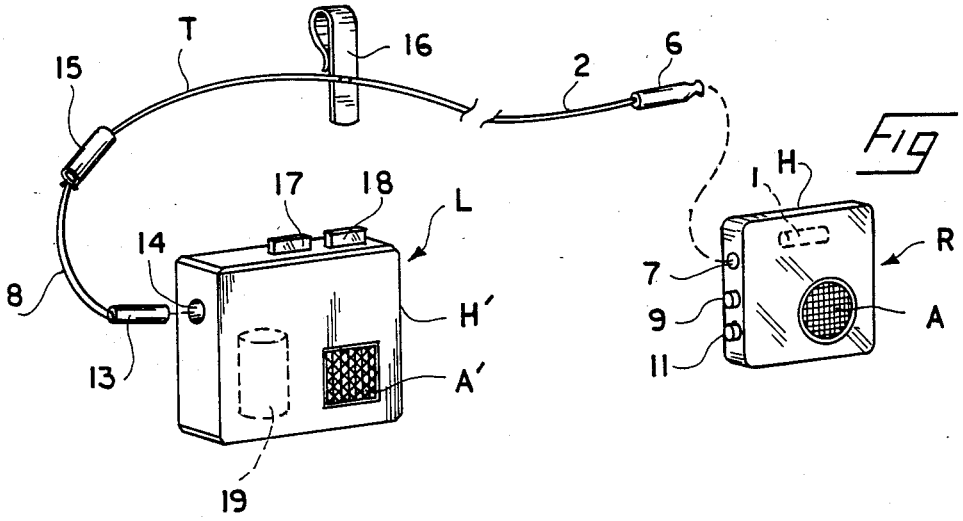
FIG. 2 is a perspective view of another embodiment of the invention showing first and second alarms and a tether.
Figure 3:
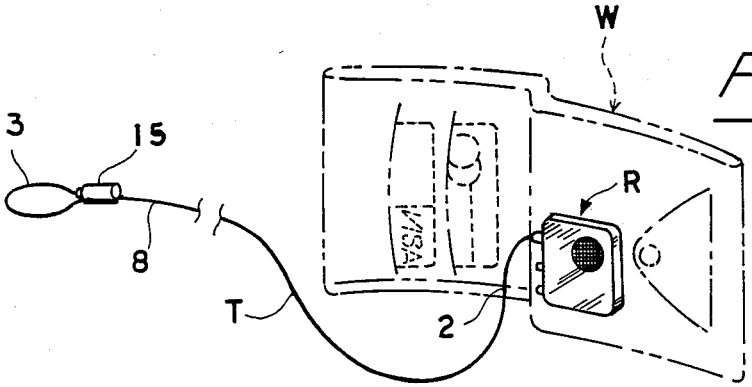
FIG. 3 is a perspective view of the first alarm as installed in a wallet.

In a second embodiment, shown in FIG. 2, a second, local alarm L comprising a housing H′ containing an alarm device A′ is shown connected to the second end 8 of the tether T with the plug 13 on the tether being inserted into a jack or receptacle 14 on the alarm L. A suitable fastener 16 mechanically attaches the alarm L and/or tether T to the user or other object carried or worn by the user. Local alarm L is provided with a self-contained energy source 19, a test switch 17 and an arming switch 18. Actuating the test switch 17 activates the alarm device A′ to momentarily test its operation with the arming switch 18 serving to switch the alarm L into an operational or ready condition.

The local alarm L is actuated upon disconnection of the first end connector 6 of the tether T from the remote alarm R contained in the article being protected, or by severing it by one means or another. Either of these actions will be seen to interrupt the continuity of the alarm circuit and trigger the remote alarm R as in the first embodiment, and will also trigger the local alarm L, alerting the user that the remote alarm R has been activated and a theft has been committed. The local alarm device A′ can also be heard by the thief, as well as the remote alarm device A.

The energy source 19 within the local alarm housing H′ supplies power requirements for the alarm device A′ and through the conductive tether T, may provide energy to recharge the energy source 1 in the remote alarm R.

The local alarm L, like the remote alarm R, is provided with any suitable fastening means such as a clip or Velcro strip to attach it to the user's clothing or to objects one may be carrying, such as a purse or the like. The energy source 19 in the local alarm L may be either replaceable or rechargeable so that at all times the system can be maintained in the ready condition.

Additionally, it is proposed that the two alarm devices A,A′ will emit their respective signals at different pitches or tones, thereby providing a distinction between the alarm as issuing from the owner's local device L and that issuing from the remote device R in the possession of the thief.

In the use of either variation of the present invention, it will be appreciated that means have been provided wherein a remote alarm housing contained within an article to be protected, includes an audible alarm that is triggered after the article has been removed from the immediate proximity of the owner, thereby alerting both the thief and the owner that a crime has been committed.

It is to be understood that the present invention is not limited to the sole embodiment described above, but encompasses any and all embodiment within the scope of the following claims.

We claim:

1. A portable security apparatus comprising;

a remote housing adapted to be carried within an article desired to be protected by an individual, an energy source within said housing, an alarm device adapted to be driven by said energy source, a flexible elongated tether having opposite end portions, said tether being long enough so that when stretched from an individual the end distal of the individual is out of reach of the individual, connection means on one said tether end portion removably joining said tether to said housing, said alarm device activated upon separation of said tether from said remote housing, a local housing adapted to be carried adjacent the person of said individual, a second alarm device within said local housing, detachable securing means joining said other tether end portion to said local housing, and an energy source within said local housing and adapted to drive said second alarm device within said local housing.

2. A portable security apparatus according to claim 1 wherein, said connection means includes a plug on said tether one end portion engageable with a mating receptacle on said housing.

3. A portable security apparatus according to claim 1 wherein, said tether comprises an electrically conductive member which when joined to said housings prevents activation of said alarm devices.

4. A portable security apparatus according to claim 1 wherein, said tether comprises an electrically conductive member, whereby activation of said remote housing alarm device is caused by disconnection of said tether which causes said local housing alarm device simultaneously to be activated.

5. A portable security apparatus according to claim 1 wherein, said tether comprises an electrically conductive member, and said local housing energy source is adapted to recharge said energy source in said remote housing, through said tether.

6. A portable security apparatus according to claim 1 wherein, said alarm device comprises an audible alarm.

7. A portable security apparatus according to claim 1 wherein, said second alarm device comprises an audible alarm.

8. A portable security apparatus according to claim 1 wherein, both said alarm devices comprise audible alarms with each said audible alarm emitting a distinctive signal.

* * * * *